US007584516B1

(12) United States Patent
Sneed

(10) Patent No.: US 7,584,516 B1
(45) Date of Patent: Sep. 8, 2009

(54) KNEE PILLOW

(76) Inventor: Ernest S. Sneed, 2123 Chestnut Oaks Rd., Powhatan, VA (US) 23139

( * ) Notice: Subject to any disclaimer, the term of this patent is extended or adjusted under 35 U.S.C. 154(b) by 0 days.

(21) Appl. No.: 12/364,906

(22) Filed: Feb. 3, 2009

(51) Int. Cl.
*A47G 9/00* (2006.01)

(52) U.S. Cl. ..... 5/650; 5/648; 5/640; 2/23; 224/579; 224/660; 297/4

(58) Field of Classification Search ..... 5/650, 5/648, 653, 640; 297/4, 485; 2/23, 24; 224/579, 224/660; 602/26; 128/845
See application file for complete search history.

(56) References Cited

U.S. PATENT DOCUMENTS 589,562 A * 9/1897 Gray ..... 2/51
2,257,848 A * 10/1941 Larkin ..... 5/630
2,266,886 A * 12/1941 McCoy ..... 2/22
2,460,895 A * 2/1949 Meany ..... 602/26
2,637,032 A * 5/1953 Pinsuti ..... 2/23
3,938,569 A * 2/1976 Hill ..... 150/110
4,074,740 A * 2/1978 Anderson ..... 150/106
4,177,806 A * 12/1979 Griffin ..... 128/892
4,252,112 A * 2/1981 Joyce ..... 602/26
6,654,962 B2 * 12/2003 DeMott ..... 2/22

* cited by examiner

*Primary Examiner*—Alexander Grosz
(74) *Attorney, Agent, or Firm*—Goodman Allen & Filetti, PLLC; Charles M. Allen; Thedford I. Hitaffer

(57) ABSTRACT

A knee pillow assembly comprises a pillow and a tether assembly. The tether assembly comprises a tether and a waistband. The tether is supported in relation to the pillow at a first end and in relation to the waistband at a second end. The waistband is structured for attachment about a person's waist. The tether is adjustable in relation to the pillow so that the pillow may be positioned in relation to the waistband and between the person's knees to reduce the risk of the knees coming into contact. In accordance with a method of the invention, a waistband is attached to a person's waist by forming a first releasable knot with the waistband. A pillow is attached to the tether in relation to the pillow by forming a second releasable knot between a free end of the tether and a loop supported in relation to the pillow.

14 Claims, 3 Drawing Sheets

KNEE PILLOW

BACKGROUND OF THE INVENTION

This invention relates in general to health aids and more particularly to an apparatus used to assist in sleeping comfortably. The invention relates to a pillow assembly that is adapted to prevent chafing between portions of adjacent limbs.

Many people have painful arthritis and knee conditions which results in discomfort that can interfere with sleep. Prolonged contact of the knees and ankles can lead to bruising or chafing, which can also result in discomfort that interferes with sleep. Additionally, persons recovering from certain medical procedures, or pregnant women, are often required to rest or sleep in positions that result in prolonged contact of the knees, resulting in discomfort and sleep interference.

SUMMARY OF THE INVENTION

This invention relates to a knee pillow assembly, which can be positioned between a person's legs to reduce the risk of the knees coming into contact, and thus facilitate comfortable and restful sleep. The assembly comprises a pillow and a tether assembly. The tether assembly comprises a tether and a waistband. The tether is supported in relation to the pillow at a first end and in relation to the waistband at a second end. The waistband is structured for attachment about a person's waist. The tether is adjustable in relation to the pillow so that the pillow may be positioned in relation to the waistband and between the person's knees to reduce the risk of the knees coming into contact.

The invention also relates to a method for positioning a pillow between a person's knees. The method comprises the steps of attaching the waistband to the person's waist by forming a first releasable knot with the waistband and attaching the tether in relation to the pillow by forming a second releasable knot between a free end of the tether and a loop supported in relation to the pillow.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
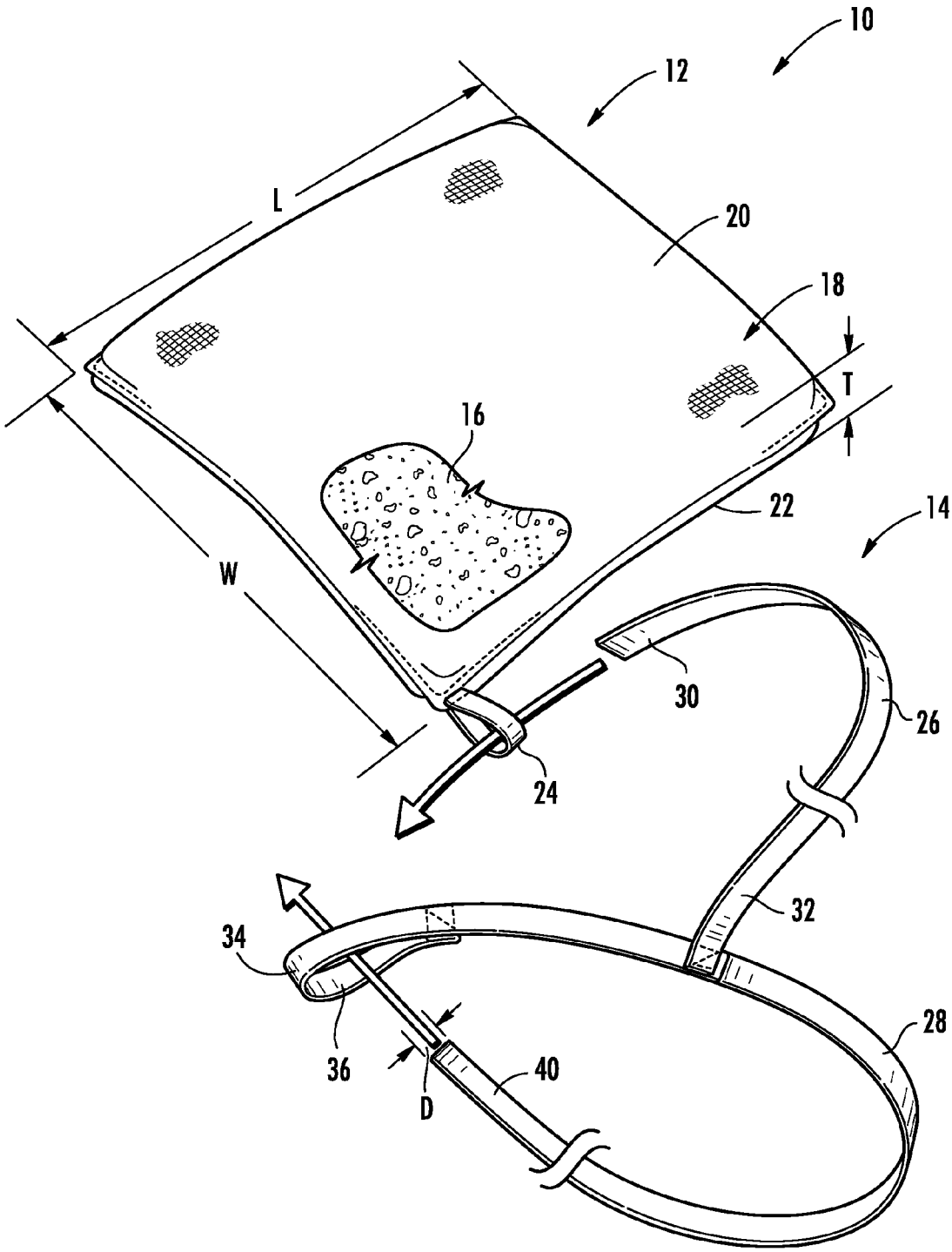
FIG. 1 is a partially exploded perspective view of an exemplary knee pillow assembly.

Referring now to the drawings, there is illustrated in FIG. 1 a knee pillow assembly, generally indicated at 10, which may comprise a pillow 12 and a tether assembly 14. The pillow 12 may comprise a core 16 and a cover 18 about the core 16. The pillow 12 is adapted to be positioned between a person's knees to reduce the risk of the knees coming into contact, and thus facilitate comfortable and restful sleep to prevent chafing between portions of the person.

The core 16 may be of any suitable construction. For example, the core 16 may comprise materials, such as a synthetic material (for example, polyester or polyurethane), a non-synthetic material (for example, cotton, feathers, down) or a combination thereof, or comprise a bladder (i.e., an inflatable volume) and an inflating fluid (for example, a liquid or a gas). The core 16 may include a block, or batting or filling, or other suitable structure. A firm density polyurethane foam block, such as an H45 polyurethane foam block, may form a suitable core. Although the core 16 may be any suitable size, a H45 polyurethane foam block having a thickness T of about 1-3 inches (7.5 cm) and length and width L, W that are about 10 inches (25.4 cm), when positioned between a person's legs, reduces the risk of the knees coming into contact, and thus facilitates comfortable and restful sleep for the user.

The cover 18 may be a fabric in the form of cotton, polyester, or a combination thereof, which may be machine washable and provide breathable, comfortable protection. The cover 18 may comprise a moisture wicking fabric, which pulls moisture away from the person's skin to keep the person dry. The cover 18 may fit tightly about the core 16. The cover 18 may be formed from two cotton polyester blend sheets 20, 22, which may be 11 inches (27.9 cm) square, and which may be stitched or otherwise fastened together about the perimeter of the sheets 20, 22. Such a cover may fit tightly about the H45 polyurethane foam block described above.

The tether assembly 14 may be attached to, or otherwise supported in relation to the cover 18. This may be accomplished in any suitable matter. For example, the illustrated pillow 12 has a loop 24 attached to a corner thereof, although the loop 24 may be attached at other suitable locations. The tether assembly 14 may in turn be attached to the loop 24.

The tether assembly 14 and the loop 24 may be in any suitable form and be constructed in any suitable matter. For example, the tether assembly 14 and the loop 24 may be in the form of a flat tie string, which may be cotton, polyester or a blend thereof, similar to the cotton twill tape used to tie hospital gowns and tie string scrub pants. Such a tape having a width D of about ½ inch (1.3 cm) may form a suitable material for the tether assembly 14 and loop 24, providing the tape is sufficiently strong and durable, yet comfortable and machine washable.

An exemplary tether assembly 14 may be substantially T-shaped, having a first leg, or a tether 26, and a second leg, or waistband 28, which may be transverse or perpendicular to the tether 26. The tether 26 may be structured for supporting the pillow 12 in relation to the waistband 28. The waistband 28 may be structured for attachment about the person's waist. The tether 26 may have a free, or first end 30, which may be attached in relation to the pillow 12, and a second end 32, which may be attached to, or in relation to the waistband 28. Although the tether 26 may be any suitable length, a tether that is about 32 inches (81.3 cm) long may be a suitable length to support the pillow 14 between the person's knees when the waistband 28 is attached about the person's waist. Although the waistband 28 may be any suitable length, a waistband that is about 70 inches (177.8 cm) long may be a suitable length for most users.

As shown in the drawings, the tether 26 may be attached to the waistband 28 at a point along the waistband 28 that is closer to a first end 34 of the waistband 28. Although other points of attachment may be suitable, attachment of the tether 26 at a point that is about 5 inches (12.7 cm) from the first end 34 of the waistband 28 may facilitate in the placement of the tether 26 in front of the person, providing that the first end 34 is structured to facilitate the attachment of the waistband 28 about the person's waist. Although any suitable structure may facilitate the attachment of the waistband 28 about the person's waist, such structure may include a loop 36 provided at the first end 34 of the waistband 28 which may cooperate with the second end 40, as will become more apparent in the description that follows.

Figure 2:
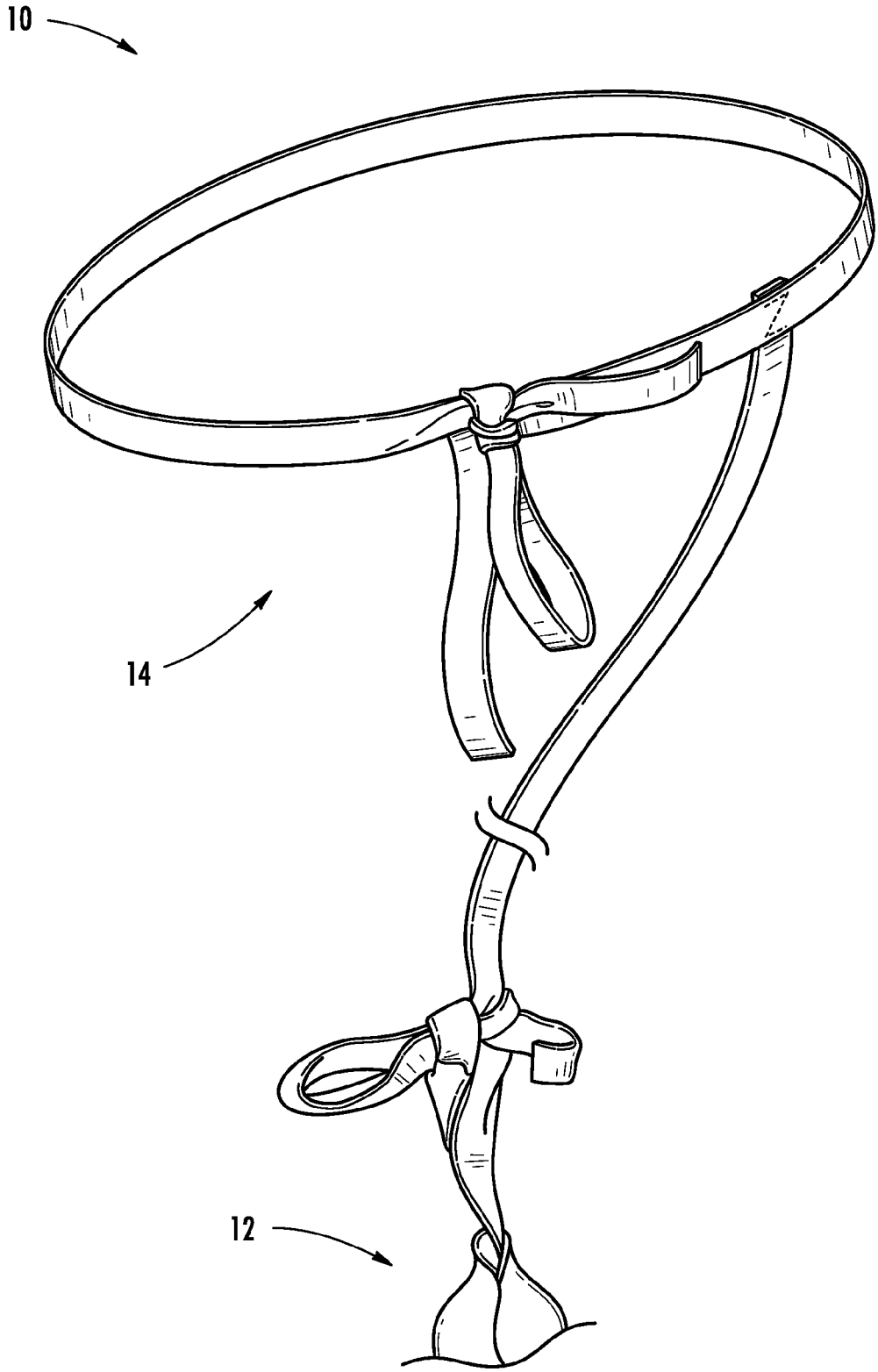
FIG. 2 is an environment perspective view of the assembly shown in FIG. 1.
Figure 5:
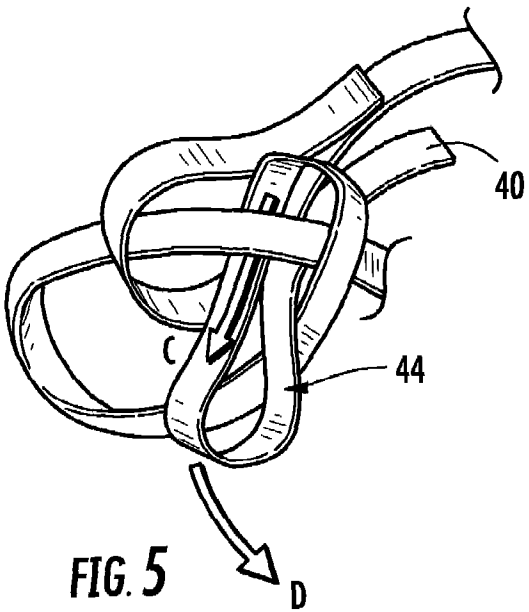
FIGS. 3-5 are perspective views of a manner in which a waistband of the pillow assembly is attached about a person's waist.
Figure 4:
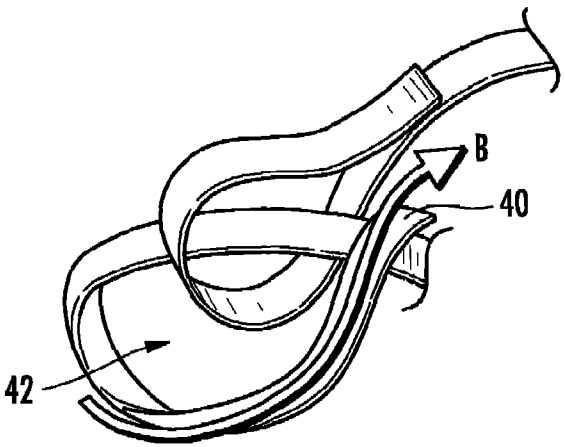
Figure 3:
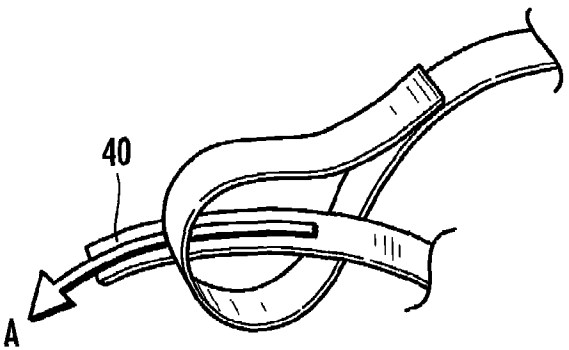

The operation of the assembly 10 is best understood with reference to FIGS. 2-5. As shown in FIG. 2, the waistband 28 may be passed about the person's waist. The second end 40 may be passed completely through the loop 36 at the first end 34 of the waistband 28 in the direction of arrow A in FIG. 3, with the loop 36 being positioned in front of the person. Now, the second end 40 may be doubled back in the direction of Arrow B shown in FIG. 4 and passed over the waistband 28. Next, the second end 40 may be passed in the direction of Arrow C under the waistband 28, doubled back, and then partially passed through a loop 42 just formed, so as to form a third loop 44. The third loop 44 may be pulled in the direction of Arrow D until the loop 42 just formed closes and tightens up, thus forming a first releasable knot. This attaches the waistband 28 about the person's waist, as shown in FIG. 2.

With the waistband 28 attached about the person's waist, the pillow 12 may be positioned between the person's knees. Once positioned as desired, the first end 30 of the tether 14 may be attached, via a second releasable knot, to the loop 24, which is attached to a corner of the pillow 12, in a manner similar to the manner in which the second end 40 of the waistband 28 is attached to the loop 36 at the first end 34 of the waistband 28, as described in the paragraph above with reference to FIGS. 3-5.

With the waistband 28 attached about the person's waist, and the tether 26 attached to a corner of the pillow 12, the pillow 12 may be held in the desired positioned between the person's knees. The tether is easily adjustable by loosening and adjusting the tether 26 in relation to the loop 24, and then re-attaching the tether in relation to the loop 24. The waistband 28 may be similarly adjustable. It should be appreciated that the waistband and tether described above may be attached without the need of mechanical fasteners, such as buckles, buttons, snaps, zippers, or hook-and-loop type fasteners. Hence, the person using the assembly 10 does not encounter discomfort associated with such fasteners.

It should be appreciated that the pillow 12 is not intended to be limited by the description above. For example, the pillow 12 may be other shapes or sizes, including square, rectangular, round, cubical, spherical, tapered, or hour glass-shaped pillows of varying sizes. The pillow 12, including the core 16 and cover 18, may be formed on varying compositions. For example, the core 16 may be formed of foam, fiber batting, down, or other suitable materials or a combination thereof, and the cover 18 may be formed from cotton, wool, polyester, damask, silk, shantung, lightweight home decor fabrics, lightweight jacquards, or other suitable fabrics or blends thereof.

It should also be appreciated that the tether assembly 14 is not intended to be limited by the description above. For example, the tether 26 may be in the form of string, rope, cord, strap, or other suitable structure formed from natural or synthetic materials, and waistband 28 may be in the form of a belt, strap or the like formed from natural or synthetic materials, and may be provided with any suitable fastener, including, for example, buckles, buttons, snaps, zippers, or hook-and-loop type fasteners.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A knee pillow assembly comprising:

a pillow, and a tether assembly comprising a tether and a waistband, the tether being supported in relation to the pillow at a first end and in relation to the waistband at a second end, the waistband being structured for attachment about a person's waist, the tether being adjustable in relation to the pillow so that the pillow may be positioned in relation to the waistband and between the person's knees to reduce the risk of the knees coming into contact, the pillow having a loop attached thereto, the tether assembly being attached to the loop by a releasable knot, the tether assembly being substantially T-shaped and having a first leg that defines the tether and a second leg that defines the waistband.

2. The assembly of claim 1, wherein the pillow comprises a core comprising a firm density polyurethane foam block.

3. The assembly of claim 2, wherein the foam block is an H45 polyurethane foam block.

4. The assembly of claim 2, wherein the foam block has a thickness of about 1 inch, a length that is about 10 inches, and a width that is about 10 inches.

5. The assembly of claim 1, wherein the pillow comprises a cover in the form of a cotton and polyester blend fabric.

6. The assembly of claim 5, wherein cover is formed from two sheets which are about 11 inches square, and which are stitched together about the perimeter of the sheets so that the cover fits tightly about the core.

7. The assembly of claim 1, wherein the tether assembly and the loop are formed from a cotton twill tape.

8. The assembly of claim 7, wherein the tape has a width of about ½ inch.

9. The assembly of claim 1, wherein the tether is about 32 inches long and the waistband is about 70 inches.

10. The assembly of claim 1, wherein the tether is attached to the waistband at a point along the waistband that is closer to an end of the waistband.

11. The assembly of claim 1, wherein the tether is attached to the waistband at a point that is about 5 inches from an end of the waistband.

12. The assembly of claim 1, wherein a loop is provided at a first end of the waistband and the waistband has a portion that cooperates with the loop via a releasable knot.

13. A method for positioning a pillow between a person's knees to reduce the risk of the knees coming into contact, the method comprising the steps of:

a) providing a pillow;

b) providing a generally T-shaped tether assembly comprising a tether supported in relation to a waistband;

c) attaching the waistband to the person's waist by forming a first releasable knot with the waistband; and d) attaching the tether in relation to the pillow by forming a second releasable knot between a free end of the tether and a loop supported in relation to the pillow.

14. The method of claim 13, wherein the tether is adjustable in relation to the loop by releasing and reforming the second releasable knot.

* * * * *